United States Patent [19]

Mauch

[11] Patent Number: 4,760,655

[45] Date of Patent: Aug. 2, 1988

[54] INSOLE

[76] Inventor: Walter Mauch, Klemensplatz 10, D-4000 Duesseldorf 31, Fed. Rep. of Germany

[21] Appl. No.: 882,503

[22] Filed: Jul. 7, 1986

[51] Int. Cl.[4] ..... A43B 13/40; A43B 13/38

[52] U.S. Cl. ..... 36/44; 36/43; 128/582

[58] Field of Search ..... 36/43, 44, 71, 11.5; 128/581, 582

[56] References Cited

U.S. PATENT DOCUMENTS

| | | | |
|---|---|---|---|
| 1,730,466 | 10/1929 | Mallott | 36/44 |
| 1,867,431 | 7/1932 | Wood | 36/44 |
| 1,960,418 | 5/1934 | Schaller | 36/43 |
| 2,404,731 | 7/1946 | Johnson | 36/44 |
| 3,722,113 | 3/1973 | Birkenstock | 36/43 |
| 3,859,727 | 1/1975 | Nakamoto | 36/44 |
| 4,020,570 | 5/1977 | Shames | 36/44 |
| 4,047,310 | 9/1977 | Sunoo | 138/582 |
| 4,076,876 | 2/1978 | Boures | 36/71 |
| 4,079,526 | 3/1978 | Fukuoka | 36/44 |
| 4,109,661 | 8/1978 | Fukuoka | 36/11.5 |
| 4,226,031 | 10/1980 | Wong | 36/11.5 |
| 4,674,203 | 6/1987 | Goller | 36/44 |
| 4,694,590 | 9/1987 | Greenawalt | 36/44 |
| 4,694,831 | 9/1987 | Seltzer | 36/43 |

FOREIGN PATENT DOCUMENTS

| | | | |
|---|---|---|---|
| 936975 | 12/1955 | Fed. Rep. of Germany . | |
| 2619410 | 11/1976 | Fed. Rep. of Germany | 36/11.5 |
| 3131163 | 3/1983 | Fed. Rep. of Germany . | |
| 8304272 | 10/1983 | Fed. Rep. of Germany . | |
| 3227505 | 1/1984 | Fed. Rep. of Germany . | |
| 8507024 | 3/1985 | Fed. Rep. of Germany . | |
| 3508582 | 2/1987 | Fed. Rep. of Germany . | |
| 2066049 | 7/1981 | United Kingdom | 36/44 |

OTHER PUBLICATIONS 7 page TopMan GmbH publication—Finn Comfort, not dated.

PCT publication WO86/03394, 12/1985.

Kunstatoff-Taschenbuch, Dr. F. Pabst, 17th Edition, 1967, pp. 302, 303.

*Primary Examiner*—Steven N. Meyers

*Attorney, Agent, or Firm*—Foley & Lardner, Schwartz, Jeffery, Schwaab, Mack, Blumenthal & Evans

[57] ABSTRACT

An insole (10) exhibits on its upper side facing the sole of the foot, in the region of the foot's reflex zones, flat, somewhat lenticular softly resilient massaging cushions (3,4,5,6,7,8), made of latex rubber for example, corresponding in contour and extent to the respective reflex zone to be stimulated.

22 Claims, 1 Drawing Sheet

Fig.1
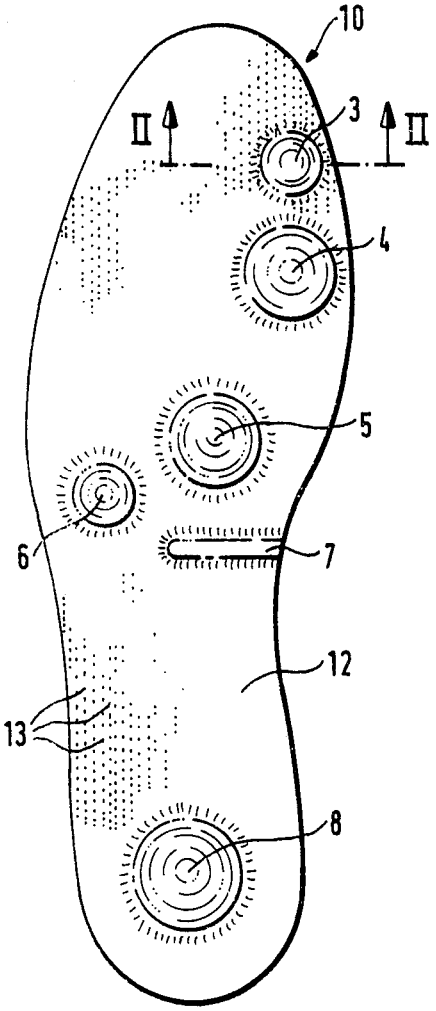
Fig.2
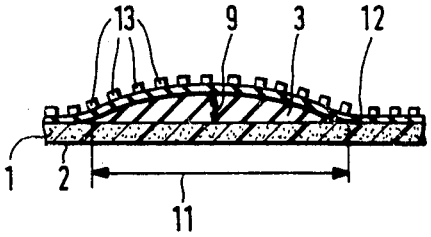
Fig.3
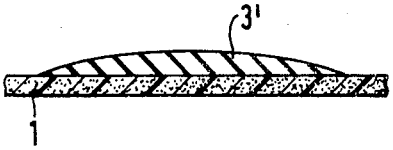
Fig.4
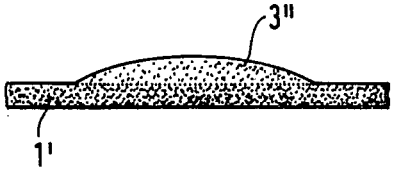
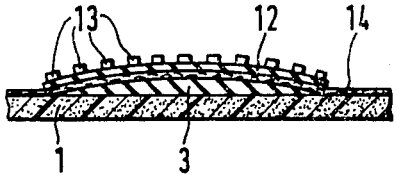
Fig.5

INSOLE

BACKGROUND OF THE INVENTION

1. Field of the Invention

The invention relates to an insole having a yielding base sole corresponding to the contours of the foot.

Two types of insole are to be distinguished. The first type of insole has a supporting function and influences the position of the bones in the foot and in the leg. Such supporting inlays must exhibit a relief which withstands quite substantial forces and is accordingly of firm construction. The relief may be formed by supports attached on a flat inlay, which may also be arranged detachably theron (German Offenlegungsschrift No. 3,131,163). Such insoles which shape the foot are not the object of this invention.

The other type of insole influences the tissue of the foot as regards its blood circulation and/or the stimulation of nerve strands which connect the foot to organs located in other parts of the body. The sole of the foot contains, for all organs and connective tissue structures such as spinal column and joints, precisely localized and limited so-called reflex zones, from which the nerve strands depart. Any massage of the reflex zones triggers nerve impulses. The latter are transmitted to the associated remotely located organ or connective tissue structure, whereby the later obtain better blood circulation and the metabolism is stimulated. In this way it is possible, from the foot, to promote the blood circulation of organs and connective tissue structures and to enhance well-being and efficiency. The position in the foot of the reflex zones associated with the individual organs or connective tissue structures is known.

2. Description of the Related Art

Insoles such as are disclosed in German Offenlegungsschrift No. 32 27 505, which forms the basis of the preamble of claim 1, are known for stimulating the reflex zones. In the known embodiment permanent magnets, incorporated in the insole, are intended to achieve advantageous effects which are based substantially upon an improved blood circulation in the tissue. The magnets are hard discs or pills which can form pressure points in an insole which are found disagreeable. In order to solve this problem, in the known construction a massage fabric applied areally on the insole is provided, which is raised locally in the region of the magnets by an interlay of resilient material projecting above the level of the insole.

The interlay is therefore intended to prevent pressure points forming in the foot on the hard magnets. If this aim is to be achieved, the interlay itself must exhibit a substantial compression resistance and be capable of distributing the forces due to the body weight. This means that the interlay must exhibit a mechanical construction which is similar to the supporting insoles referred to initially.

It has now been discovered that the effect of such insoles with relatively hard cushions is limited as regards the stimulation of the reflex zones, because overstimulation occurs after a short time due to the harsh influence of the hard elevations.

For this reason constructions as according to German Utility Model No. 8,304.272 are also not very advantageous in which lenticular elevations made of a harder material are provided in the material of the insole, at least in the region provided for the pressure contact with the sole of the foot.

SUMMARY OF THE INVENTION

The underlying aim of the invention is to develop an insole which is comfortable to wear, in which the massage of the reflex zones is more efficacious by the avoidance of overstimulation.

In the case of the insole according to the invention the reflex zones are massaged only gently. Due to the softly resilient construction of the elevations in combination with their flat shape and with their support upon an only slightly harder base sole, any boring of the elevations into the sole of the foot, and hence any excessively intense attack on the reflex zones, is prevented. It has been discovered that by this means it is possible to achieve not only a more agreeable wearing of the insoles, but more particularly a durable effect by soft stimulation of the reflex zones. The somewhat harder cover sole is essential for the durability of the insole, in as much as it prevents any immediate disruption of the soft cushions by direct attack of the loads transmitted by the foot. The burls or ribs provided on the cover sole serve for better ventilation and thereby likewise contribute to preventing the insoles from being found uncomfortable.

A uniform burl relief to achieve ventilation, considered separately, is known in the case of insoles from German Pat. No. 936,975.

Latex rubber may be considered as a preferred material for the cushions.

The invention also extends to an insole system, in which specific reflex zones associated with specific types of organs deliberately influence said types of organs.

BRIEF DESCRIPTION OF THE DRAWINGS

Examples of construction of the invention are illustrated diagrammatically in the drawing, wherein:

FIG. 1 shows a plan view of an insole according to the invention;

FIG. 2 shows a cross-section made on the line II—II in FIG. 1;

FIGS. 3 to 5 show corresponding cross-sections through variant forms of construction.

DESCRIPTION OF THE PREFERRED EMBODIMENTS

The insole, generally designated 10 in FIG. 1, comprises a base sole 1 (FIG. 2) made of a suitable yielding flat material, for example, a fine-pore foam rubber or a corresponding plastic material with a surface closed at least on the underside 2, which forms a blank corresponding to the outline of the shoe and/or foot. At the positions of the reflex zones to be stimulated, cushions 3,4,5,6,7, 8, made of a softly yielding material such as latex rubber or the like are attached to the top side of the base sole 1, their contour corresponding substantially to the contour of the reflex zones to be stimulated. In the exemplary embodiment shown in FIG. 1 the cushions 3,4,5,6, 8 are substantially circular, whereas the cushion 7 has an elongate configuration. The cushions are of somewhat lenticular construction, that is to say, they increase in height from a very flat edge towards the center. In the unloaded state the height 9 in the center (FIG. 2) is approximately 10 to 20% of the central diameter 11, in the exemplary embodiment 13%.

In the exemplary embodiment shown in FIGS. 1 and 2 the cushions are separate mouldings which are glued or vulcanized onto the base sole 1. In the exemplary embodiment of FIGS. 1 and 2 a cover sole 12 made of a thin rubber material is also provided, which is provided on its surface with uniformly distributed burls 13 which form the actual support surface for the sole of the foot. The burls may have, for example, a diameter of approximately 1 millimeter and a minimum mutual interval of the same order of magnitude in each case. The thickness of the base material of the cover sole 12 in the example shown is approximately 0.5 mm, the thickness of the base sole 1 approximately 2 mm. The base sole 1 consists of an extremely fine-pore foamed EVA material (ethylene-vinyl acetate copolymer) with a density of approximately 0.15 g/cm$^3$ and with a Shore A hardness of approximately 30. The cover sole consists of solid rubber material with a Shore A hardness of approximately 60 and with a density of approximately 1.30 g/cm$^3$.

The burls 13 may extend over the entire surface of the cover sole 12; however, certain zones may also remain free of the burls 13.

The cover sole 12 is attached to the base sole 1 on its total surface, for example, glued or vulcanized together, and adapts itself faithfully to the upper side of the base sole 1 by the relief formed by the cushions 3 to 8.

In the embodiment shown in FIG. 3 a cover sole 12 is omitted and the cushion 3' directly forms the surface of the insole in the region of the relevant reflex zone.

FIG. 4 exhibits an exemplary embodiment in which a cushion 3'' is shaped directly and integrally onto a base sole 1, for example by injection moulding in a mould in one operation. As is indicated by the dotting of the cushion 3'' in FIG. 4, the cushion 3'' is softer than the base sole 1'. It will not generally be possible to produce the entire insole from uniform material. In fact, the base sole 1,1' must exhibit a certain tensile strength in its plane, so that it does not become deformed in the shoe, and slip therein, during walking. For the cushions 3,3',3'',4 to 8 the primary consideration is that they are softly yielding. They must therefore generally be softer than the remaining material of the sole.

In the embodiment according to FIG. 5 the entire insole is covered by a cover sole 14 made of leather approximately 1 mm thick. This contributes to the formal stability of the insole and facilitates the introduction of the foot into the shoe when the insole is present therein. Here again a rubber layer 12 with burls 13 is present, but does not cover the entire insole (as in FIG. 2), but only individual points, the cushions 3 for example.

In all the embodiments it should be possible to compress the cushions appreciably by relatively slight finger pressure. This is ensured if the hardness is approximately 15 to 30 Shore A. In the exemplary embodiment there is a latex material with a hardness of approximately 22 Shore A and with a density of approximately 0.56 g/cm$^3$.

The position of the reflex zones in the sole of the foot is known. The position and contour shape of the cushions is governed according to the reflex zone to be stimulated. Naturally, not all the known reflex zones are stimulated in one insole, but generaly deliberately determined groups, for example the groups which correspond to the excretory organs, to the metabolic organs, to the digestive organs or to the heart-circulation organs. In the exemplary embodiment illustrated in FIG. 1, the individual cushions correspond to the following organs: 3: pituitary gland; 4: thyroid gland; 5: adrenal glands; 6: spleen; 7: pancreas; 8: pelvic organs.

The reflex zone picture of the right and left foot may be different. The respective reflex zone picture is compressed or expanded similarly for insoles of different sizes.

I claim:

1. An insole comprising a yielding base sole corresponding to the contour of a foot having reflex zones, and further having yielding cushions in the region of the reflex zones on an upperside facing the sole of the foot, and a yielding cover sole which adapts itself to the cushions and covers substantially the total surface of the base sole, the base sole comprising a material having a hardness of 30° to 35° Shore A and a specific weight of 0.12–0.20 g/cm$^3$, the cushions comprising a rubber resilient foam material having a hardness of 12° to 30°, Shore A and a specific weight of 0.15 to 0.60 g/cm$^3$, the height of the cushions in the center in an unloaded state being 10% to 20% of a cushion central diameter, the cover sole comprising a material having a hardness of 55° to 70° Shore A and a specific weight of 1.10 to 1.40 g/cm$^3$, and having a uniform relief formed by burls or ribs, small in proportion to the length and width of the insole and positioned closely juxtaposed, forming an interrupted support surface for the foot on at least a partial surface of the upperside of the insole.

2. An insole as claimed in claim 1, wherein the cushions consist of latex rubber.

3. An insole as claimed in claim 1, wherein the cushions are attached to the base sole.

4. An insole as claimed in claim 1, where the cushions are integral with the base sole.

5. An insole as defined in claim 1, wherein the cushions are formed with a plurality of cover sole layers.

6. An insole system which comprises groups of insoles as claimed in claim 1; said groups of insoles exhibiting cushions which influence reflex zones known to be associated with relevant organs of the human body; each said group of insoles having differently located cushions associated with reflex zones of different organs of the human body.

7. A method of constructiong an insole for massaging a foot's reflex zones which comprises:

(a) forming a base sole;

(b) forming yielding cushions on an upperside of the base sole facing the sole of a foot in the region of a foot's reflex zones;

(c) substantially covering the yielding cushions with a yielding cover sole which adapts to the cushions and substantially covers the total surface of the base sole, including forming the base sole of a material having a hardness of about 30° to 35° Shore A and a specific weight of about 0.12–0.20 g/cm$^3$; forming the cushions of a rubber resilient foam material having a hardness of about 12° to 30° Shore A and a specific weight of about 0.15 to 0.60 g/cm$^3$, the height of the cushions in the center in an unloaded state being about 10% to 20% of a cushion central diameter; and forming the cover sole of a material having a hardness of about 55° to 70° Shore A and a specific weight of about 1.10 to 1.40 g/cm$^3$, and a uniform relief formed with burls or ribs, small in proportion to the length and width of the base sole and positioned closely juxtaposed, forming an interrupted support surface for the foot on at least a partial surface of the upperside of the base sole.

8. The method of claim 7, wherein the cushions are comprised of latex rubber.

9. The method of claim 7, wherein the cushions are attached to the base sole.

10. The method of claim 7, wherein the cushions are integrated with the base sole.

11. The method of claim 7, wherein the cushions are formed of a plurality of cover sole layers.

12. An insole for massaging foot reflex zones, comprising:

(a) an elastically yielding base sole having a form corresponding to a contour of a foot, (b) elastically yielding elevations on an upper side of the base sole associated with the contour of reflex zones of the foot, the elevations being softer than the base sole and having circumferential contours substantially corresponding to contours of the reflex zones to be massaged, (c) a cover sole covering the base sole and the elevations.

13. An insole as claimed in claim 12, wherein the elevations are attached to the base sole.

14. An insole as claimed in claim 12, wherein the elevations are integral with the base sole.

15. An insole as defined in claim 12, wherein the elevations are formed with a plurality of cover sole layers.

16. An insole system which comprises groups of insoles as claimed in claim 12; said groups of insoles exhibiting cushions which influence reflex zones known to be associated with relevant organs of the human body; each said group of insoles having differently located cushions associated with reflex zones of different organs of the human body.

17. A method for massaging foot reflex zones, comprising:

(a) forming an elastically yielding base sole corresponding to a contour of a foot, (b) forming elastically yielding elevations on the upper side of the base sole associated with the contour of the reflex zones of the foot, said elevations being softer than the base sole and having circumferential contours substantially corresponding to the contours of the reflex zones to be massaged, (c) covering the base sole and the elevations with a cover sole, and (d) placing the formed cover sole and base sole in a shoe of a wearer.

18. The method of claim 17, wherein the elevations are comprised of latex rubber.

19. The method of claim 17, including attaching the elevations to the base sole.

20. The method of claim 17, including integrating the elevations with the base sole.

21. The method of claim 17, including forming the elevations of a plurality of cover sole layers.

22. A method of constructing an insole system which comprises:

providing groups of insoles which exhibit cushions which influence reflex zones known to be associated with relevant organs of the human body, each said group of insoles having differently located cushions associated with reflex zones of different organs of the human body.

* * * * *